US009816428B2

(12) United States Patent
Callahan

(10) Patent No.: US 9,816,428 B2
(45) Date of Patent: Nov. 14, 2017

(54) EXHAUST MANIFOLD WITH TURBO SUPPORT

(71) Applicant: Faurecia Emissions Control Technologies, USA, LLC, Columbus, IN (US)

(72) Inventor: Joseph E. Callahan, Greenwood, IN (US)

(73) Assignee: Faurecia Emissions Control Technologiees, USA, LLC, Columbus, IN (US)

( * ) Notice: Subject to any disclaimer, the term of this patent is extended or adjusted under 35 U.S.C. 154(b) by 57 days.

(21) Appl. No.: 14/763,195

(22) PCT Filed: Feb. 28, 2013

(86) PCT No.: PCT/US2013/028151
§ 371 (c)(1),
(2) Date: Jul. 24, 2015

(87) PCT Pub. No.: WO2014/133511
PCT Pub. Date: Sep. 4, 2014

(65) Prior Publication Data

US 2015/0361861 A1 Dec. 17, 2015

(51) Int. Cl.
*F01N 1/00* (2006.01)
*F01N 13/18* (2010.01)
(Continued)

(52) U.S. Cl.
CPC ..... *F01N 13/1822* (2013.01); *F01N 13/10* (2013.01); *F01N 13/102* (2013.01);
(Continued)

(58) Field of Classification Search
CPC ..... F01N 13/10; F01N 13/102; F01N 13/141; F01N 13/1822; F01N 13/1861;
(Continued)

(56) References Cited

U.S. PATENT DOCUMENTS 3,667,432 A * 6/1972 Greathouse ..... F02B 77/11 123/184.38
4,537,027 A * 8/1985 Harwood ..... F01N 13/10 29/428
(Continued)

FOREIGN PATENT DOCUMENTS

DE 20 2006 015 883 U1 3/2008
DE 10 2008048 897 4/2010
(Continued)

OTHER PUBLICATIONS

Supplementary European Search Report for European Application No. 13876458.4 dated Sep. 19, 2016.

*Primary Examiner* — Jason Shanske
*Assistant Examiner* — Matthew T Largi
(74) *Attorney, Agent, or Firm* — Carlson, Gaskey & Olds, PC

(57) ABSTRACT

An exhaust manifold includes an inner assembly that defines an exhaust gas passage and an outer housing assembly that surrounds the inner assembly. The outer housing assembly includes a first housing component configured for attachment to an engine and a second housing component configured for attachment to a turbocharger. The first and second housing components cooperate to surround the inner assembly. At least one fastener secures the first and second housing components together to generate a compressive force that seals and holds the inner assembly in a gas tight manner.

21 Claims, 3 Drawing Sheets

(51) Int. Cl.
*F01N 13/10* (2010.01)
*F02B 67/10* (2006.01)
*F01N 13/14* (2010.01)

(52) U.S. Cl.
CPC ..... *F01N 13/141* (2013.01); *F01N 13/1861* (2013.01); *F01N 13/1872* (2013.01); *F01N 13/1888* (2013.01); *F02B 67/10* (2013.01); *F01N 2450/24* (2013.01); *Y10T 29/49948* (2015.01)

(58) Field of Classification Search
CPC ..... F01N 13/1872; F01N 13/1888; F01N 2450/24; F02B 67/10
See application file for complete search history.

(56) References Cited

U.S. PATENT DOCUMENTS

| | | | | |
|---|---|---|---|---|
| 4,689,952 | A | 9/1987 | Arthur et al. | |
| 4,777,708 | A | 10/1988 | Harwood et al. | |
| 5,349,817 | A * | 9/1994 | Bekkering | F01N 3/30 60/322 |
| 5,419,127 | A | 5/1995 | Moore, III | |
| 6,247,552 | B1 | 6/2001 | Kovar et al. | |
| 2005/0126163 | A1 | 6/2005 | Bjornsson, Jr. | |
| 2008/0203725 | A1 * | 8/2008 | Willeke | F01N 13/14 285/123.6 |
| 2009/0007552 | A1 * | 1/2009 | Schmidt | F01N 13/10 60/323 |
| 2009/0013679 | A1 | 1/2009 | Abe et al. | |
| 2009/0249774 | A1 * | 10/2009 | Sloss | F01N 13/102 60/323 |

FOREIGN PATENT DOCUMENTS

| | | | |
|---|---|---|---|
| EP | 1270891 | A2 | 1/2003 |
| KR | 10-0794018 | B1 | 1/2008 |
| KR | 10-11899294 | B1 | 10/2012 |

* cited by examiner

EXHAUST MANIFOLD WITH TURBO SUPPORT

TECHNICAL FIELD

The subject invention generally relates to an exhaust manifold, and more specifically relates to an exhaust manifold with turbo support and insulation.

BACKGROUND OF THE INVENTION

Exhaust gases exit engine cylinders into an exhaust manifold. From the manifold, the exhaust gases are directed toward downstream exhaust system components such as the catalytic converter and muffler, for example. Double wall exhaust manifolds have been used in an attempt to maintain exhaust gas temperatures at the high levels needed for efficient operation of emission abatement devices such as the catalytic converter.

Double wall exhaust manifolds include an inner pipe configuration that is surrounded by an outer housing. The inner pipe directs the exhaust gases to downstream exhaust components and the outer housing is spaced from the inner pipe in portions to provide an insulating air gap.

In traditional double wall configurations the inner pipe is comprised of a plurality of inner components that are secured together and the outer housing is comprised of a plurality of outer components that are secured together to surround the inner pipe. This requires a significant number of components, which can increase cost and further results in a complex assembly process. Additionally, it is difficult to hold the inner pipe within the outer housing in a gas tight and stable manner.

SUMMARY OF THE INVENTION

An exhaust manifold includes an inner assembly that defines an exhaust gas passage and an outer housing assembly that surrounds the inner assembly. The outer housing assembly includes a first housing component configured for attachment to an engine and a second housing component configured for attachment to a turbocharger. The first and second housing components cooperate to surround the inner assembly. At least one fastener secures the first and second housing components together to generate a compressive force that seals and holds the inner assembly in a gas tight manner.

In one example, a seal is positioned between an outer surface of the inner assembly and an inner surface of the outer housing assembly.

In one example, the seal maintains a gap between the inner surface of the outer housing assembly and the outer surface of the inner assembly. The seal is compressed between the inner and outer surfaces when the first and second housing components are fastened together.

In one example, the inner assembly is comprised of a plurality of stampings.

In one example, the first and second housing components comprise first and second castings.

In one example, the first casting includes an engine attachment interface and the second casting includes a turbocharger attachment interface.

One example method of assembling the exhaust manifold includes positioning a first outer housing component to surround a portion of the inner assembly, positioning a second outer housing component to surround a remaining portion of the inner assembly, and fastening the first and second outer housing components together to generate a compressive force that seals and holds the inner assembly in a gas tight manner.

In one example, the fastening step includes compressing at least one seal between an inner surface of the outer housing and an outer surface of the inner assembly.

These and other features may be best understood from the following drawings and specification.

DETAILED DESCRIPTION

Figure 1:
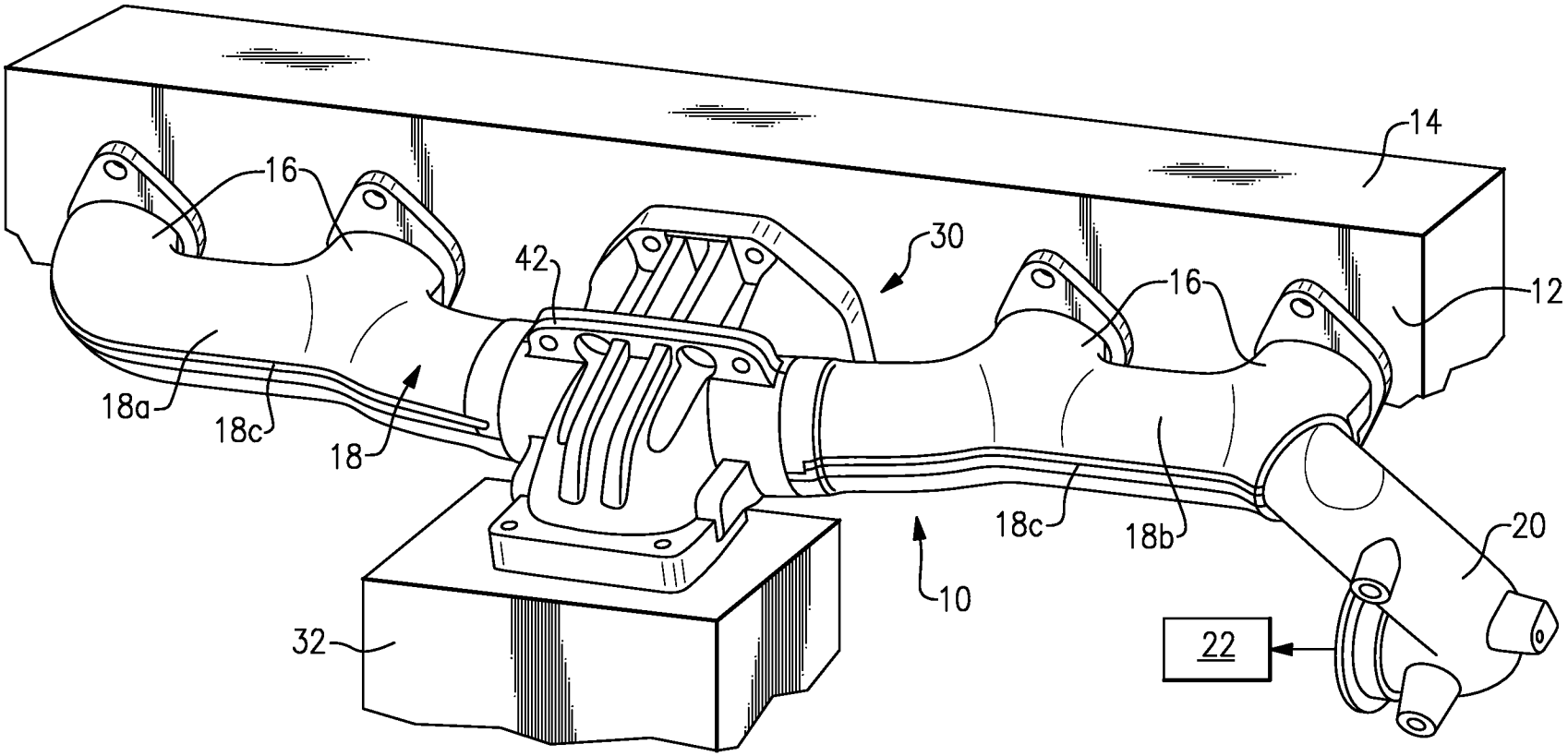
FIG. 1 is a perspective view of an exhaust manifold having a center section with an inner assembly and an outer housing to be connected to a turbocharger.

FIG. 1 shows an exhaust manifold 10 configured for attachment to a cylinder head section 12 of an engine 14. The manifold 10 includes a plurality of exhaust gas inlets 16 that direct engine exhaust gases into a collecting pipe 18. The collecting pipe 18 is connected to an exhaust system connection pipe 20 that directs exhaust gases to downstream exhaust components 22, which can include catalytic converters, mufflers, etc.

The manifold 10 also includes a center section 30 that is configured to connect the engine 14 to a turbocharger 32. In the example shown, the center section 30 is positioned between two pairs of inlets 16. The manifold center section 30 comprises a double wall configuration that includes an inner assembly 40 (FIG. 2) and an outer housing assembly 42 that surrounds the inner assembly 40.

Figure 2:
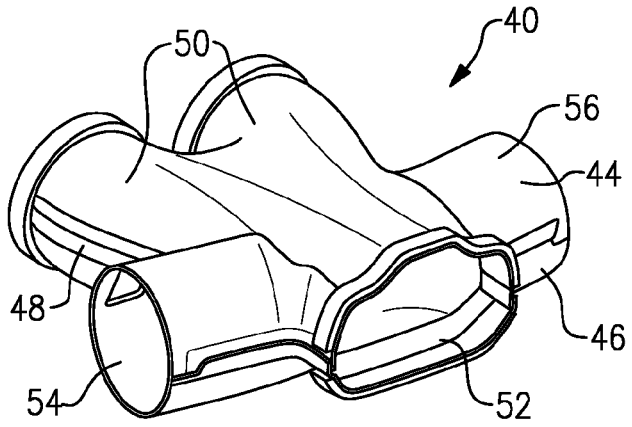
FIG. 2 is a perspective view of the inner assembly.

As shown in FIG. 2, the inner assembly 40 is a stamped assembly that is comprised of a plurality of stampings. The stampings are secured to each other to form a plurality of pipe segments. In the example shown, the inner assembly 40 includes at least a first stamping 44 and a second stamping 46 that are secured to each other at an attachment interface 48. The attachment interface 48 can comprise a welded interface or brazed interface, for example; however, other attachment interfaces could also be utilized. While two stampings are shown, it should be understood that the inner assembly could be comprised of additional stampings as needed.

The inner assembly 40 includes at least one pipe segment 50 that receives engine exhaust gases directly from the engine 14 and at least one pipe segment 52 that directs engine exhaust gases into the turbocharger 32. An upstream pipe segment 54 receives exhaust gases from the upstream inlets 16 and a downstream pipe segment 56 directs exhaust gases into the collecting pipe portion for the downstream inlets 16. Connection of the pipe segments of the inner assembly 40 to upstream, downstream, engine and turbocharger connection interfaces can be done using any known method such as welding or brazing, for example.

Figure 3:
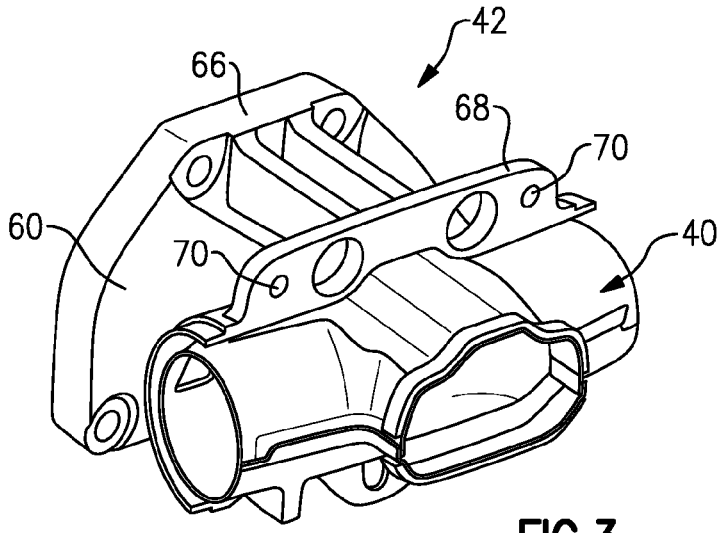
FIG. 3 is a perspective view showing the inner assembly surrounded by a first housing component of the outer housing.
Figure 4:
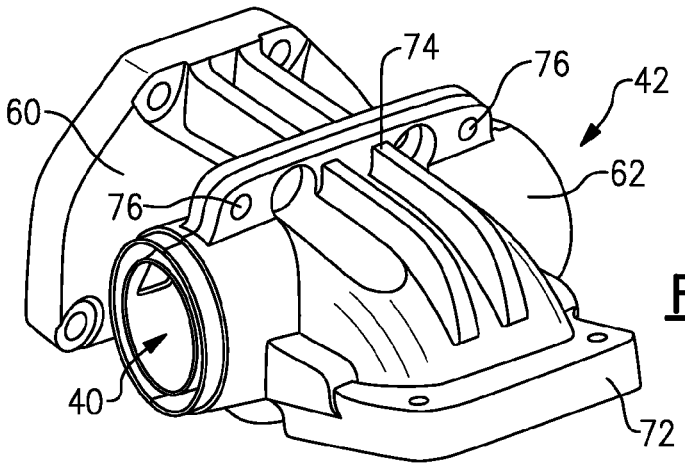
FIG. 4 is a view similar to FIG. 3 but additionally shows a second housing component of the outer housing surrounding the inner assembly.
Figure 5:
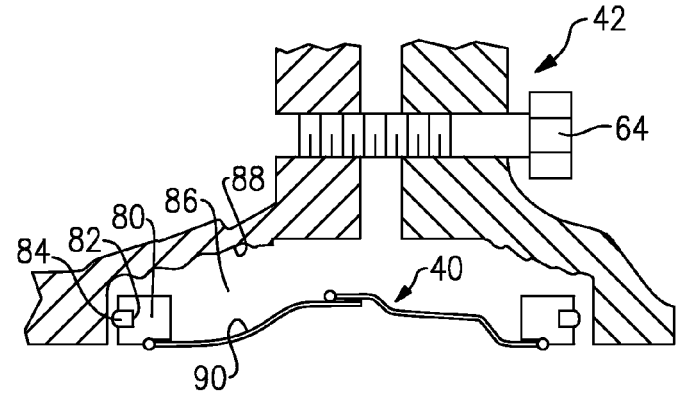
FIG. 5 is a schematic cross-sectional view showing an initial assembly position of the first and second housings relative to the inner assembly.
Figure 5:
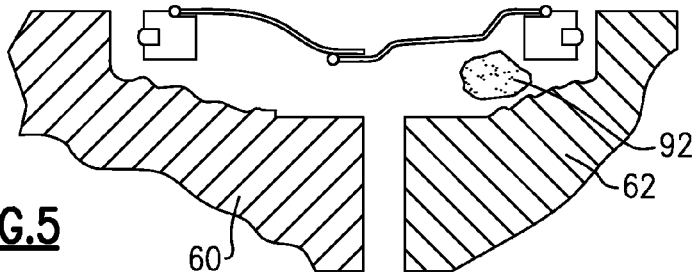
Figure 6:
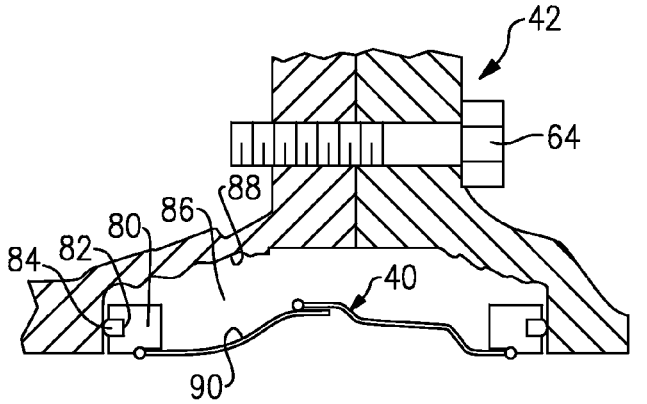
FIG. 6 is a view similar to FIG. 5 but showing a final assembled position.
Figure 6:
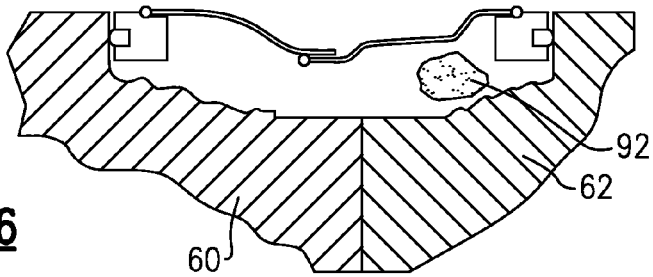

The outer housing assembly 42 is shown in greater detail in FIGS. 3-6. The outer housing assembly 42 includes a first housing component 60 and a second housing component 62 that cooperate to surround the inner assembly 40 as shown in FIG. 4. The first 60 and second 62 housing components comprise castings that are secured to each other with at least one fastener 64 (FIGS. 5-6).

The collecting pipe 18 (FIG. 1) includes a first portion 18*a* that has the pair of upstream inlets 16 and a second portion 18*b* that has the pair of downstream inlets 16. These portions 18*a*, 18*b* are comprised of stampings that are secured along an attachment interface 18*c*. The stamped portions 18*a*, 18*b* are connected to the cast outer housing assembly 42 of the center section to form the manifold 10. Thus, the manifold 10 is formed from a plurality of stamped pipe sections with a cast center housing that holds and supports the turbocharger 32.

As shown in FIG. 3, the first housing component 60 includes an engine attachment interface 66 to be attached to the engine 14 and a first mount interface 68 to be attached to the second housing component 62. The first mount interface 68 comprises a flange extension that includes one or more holes 70 for one or more fasteners 64. The first housing portion 60 surrounds a portion of the inner assembly 40 that includes the engine pipe segments 50 and part of the upstream 54 and downstream 56 pipe segments (see FIG. 3).

As shown in FIG. 4, the second housing component 62 includes a turbocharger attachment interface 72 to be attached to the turbocharger 32 and a second mount interface 74 to be attached to the first housing component 60. The second mount interface 74 comprises a flange extension that includes one or more holes 76 for one or more fasteners 64. The second housing portion 62 surrounds a remaining portion of the inner assembly 40 that includes the turbocharger pipe segments 52 and the remaining portions of the upstream 54 and downstream 56 pipe segments (see FIG. 4). The first mount interface 68 and the second mount interface 74 abut directly against each other such that holes 70, 76 are aligned with each other to receive the fasteners 64. The fasteners secure the first 60 and second 62 housing components together to generate a compressive force that seals and holds the inner assembly 40 in a gas tight manner.

As shown in FIG. 5, the inner assembly 40 includes a seal mount portion 80. In one example, the seal mount portion 80 comprises a flange that can be formed as a separate stamping that is attached to the inner assembly 40 or as part of one of the already existing stampings of the inner assembly 40. The seal mount portion 80 includes a groove 82 that is configured to receive a seal 84.

FIG. 5 shows an initial assembly position where the first 60 and second 62 housing components have been attached to each other with the fastener 64 but the fastener has not been fully installed. An air gap 86 is formed between an inner surface 88 of the outer housing and an outer surface 90 of the inner assembly 40. As the fastener 64 is tightened to the final installation position shown in FIG. 6, the seal 84 is compressed against the inner surface 88 of the outer housing. This compressive force generated by pulling the housing components together with the fasteners is used to seal and hold the inner assembly to keep the inner assembly 40 gas tight.

The air gap 86 serves as an insulting gap that helps retain the heat in the inner assembly, which increases the exhaust gas enthalpy at the turbocharger 32. In an optional configuration, the air gap 86 can be partially or completely filled with an insulating material shown schematically at 92.

A method of assembling the exhaust manifold 10 includes positioning the first outer housing component 60 to surround a portion of the inner assembly 40, positioning a second outer housing component to surround a remaining portion of the inner assembly 40, and fastening the first 60 and second 62 outer housing components together to generate a compressive force that seals and holds the inner assembly 40 in a gas tight manner.

In one example, the fastening step further includes compressing a seal 84 between the inner assembly 40 and the outer housing assembly 42.

In one example, the inner assembly 40 is assembled from a plurality of stampings. The first 60 and second 62 housing components comprise castings that are secured to each other to surround the stamped inner assembly 40. The remaining stamped pipe portions for the collecting pipe are then attached to the cast center section 30 to form the manifold 10. For example, a welded interface or brazed interface could be used; however, other attachment interfaces could also be utilized.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. An exhaust manifold comprising:

an inner assembly that defines an exhaust gas passage;

an outer housing assembly comprising a first housing component configured for attachment to an engine and a second housing component configured for attachment to a turbocharger, and wherein the first and second housing components cooperate to surround the inner assembly;

a seal positioned between an outer surface of the inner assembly and an inner surface of the outer housing assembly, and wherein the inner assembly includes a seal mount structure to seat the seal; and at least one fastener that secures the first and second housing components together to generate a compressive force that seals and holds the inner assembly.

2. The exhaust manifold according to claim 1 where the seal mount structure comprises at least one flange mount fixed to the inner assembly.

3. The exhaust manifold according to claim 1 wherein the seal maintains a gap between the inner surface of the outer housing assembly and the outer surface of the inner assembly.

4. The exhaust manifold according to claim 3 wherein the gap comprises an air gap.

5. The exhaust manifold according to claim 3 wherein the gap is filled with an insulating material.

6. The exhaust manifold according to claim 1 wherein the inner assembly is comprised of a plurality of stampings.

7. The exhaust manifold according to claim 6 wherein the plurality of stampings are attached to each other to form a plurality of pipe segments.

8. The exhaust manifold according to claim 7 wherein at least one pipe segment receives engine exhaust gas, wherein at least one pipe segment directs the engine exhaust gas into a turbocharger, and wherein at least one pipe segment directs engine exhaust gas to downstream exhaust system components.

9. The exhaust manifold according to claim 1 wherein the first housing component comprises a first casting and the second housing component comprises a second casting.

10. The exhaust manifold according to claim 9 wherein the first casting includes an engine attachment interface and the second casting includes a turbocharger attachment interface.

11. The exhaust manifold according to claim 10 wherein the first casting includes a first housing mount flange and the second casting includes a second housing mount flange that abuts directly against the first housing mount flange, the first and second housing mount flanges including sets of aligned mount holes, and wherein the at least one fastener comprises a plurality of fasteners with each fastener extending through one set of aligned mount holes.

12. The exhaust manifold according to claim 9 wherein the inner assembly is comprised of a plurality of stampings that are secured together to form a plurality of pipe segments.

13. The exhaust manifold according to claim 1 wherein the first and second housing components include mating flanges with at least one set of aligned holes, and wherein the at least one fastener extends through the aligned holes to secure the first and second housing components together and to seal and hold the inner assembly in a gas tight manner.

14. A method of assembling an exhaust manifold comprising the steps of:

providing an inner assembly that defines an exhaust gas passage;

positioning a first outer housing component to surround a portion of the inner assembly;

positioning a second outer housing component to surround a remaining portion of the inner assembly, wherein the inner assembly and the first and second outer housing components comprise a manifold center section to be connected to a turbocharger;

fastening the first and second outer housing components together to generate a compressive force that seals and holds the inner assembly in a gas tight manner;

providing a collecting pipe to be attached to a cylinder head section of an engine;

connecting a first portion of the collecting pipe to one aide of the manifold center section;

connecting a second portion of the collecting pipe to an opposite side of the manifold center section; and connecting an exhaust system connection pipe to the collecting pipe to direct at least a portion of engine exhaust gases from the collecting pipe and manifold center section to downstream exhaust system components.

15. The method according to claim 14 including providing the inner assembly as a plurality of stampings and securing the plurality of stampings together to form a plurality of pipe segments.

16. The method according to claim 15 including connecting at least one of the pipe segments to receive engine exhaust gas as an input, connecting at least one of the pipe segments to direct engine exhaust gas into a turbocharger, and connecting at least one of the pipe segments to direct engine exhaust gas to downstream exhaust system components.

17. The method according to claim 15 including providing the first and second outer housing components as castings, and providing the first and second outer housing components with mating flanges having sets of aligned holes, and wherein the at least one fastener comprises a plurality of fasteners with one fastener extending through each set of aligned holes.

18. The method according to claim 14 including positioning a seal between an inner surface of the first and second outer housings components and an outer surface of the inner assembly to maintain an air gap around the inner assembly, and wherein the seal is compressed between the inner assembly and the housing components when the first and second outer housing components are fastened together.

19. The method according to claim 18 including filling the air gap with insulating material.

20. The method according to claim 14 wherein the first and second outer housing components include at least one set of aligned openings, and including inserting at least one fastener through the aligned openings and fastening the first and second outer housing components together.

21. An exhaust manifold comprising:

an inner assembly that defines an exhaust gas passage;

an outer housing assembly comprising a first housing component configured for attachment to an engine and a second housing component configured for attachment to a turbocharger, and wherein the first and second housing components cooperate to surround the inner assembly, and wherein the inner assembly and the outer housing assembly comprise a manifold center section configured to be attached to the turbocharger;

at least one fastener that secures the first and second housing components together to generate a compressive force that seals and holds the inner assembly;

a collecting pipe configured to be attached to cylinder head section of an engine, wherein the collecting pipe has a first portion connected to one side of the manifold center section and a second portion attached to an opposite side of the manifold section; and an exhaust system connection pipe connected to the collecting pipe to direct engine exhaust gases to downstream exhaust system components.

* * * * *